US006752563B2

(12) United States Patent
Ide

(10) Patent No.: US 6,752,563 B2
(45) Date of Patent: Jun. 22, 2004

(54) COVERED HIGHWAY STRUCTURE WITH MEANS FOR EASY AND QUICK ACCESS TO TUNNEL INTERIOR

(76) Inventor: Yasuo Ide, 1482-9 Nonaka-machi, Kurume-shi, Fukuoka-ken (JP)

( * ) Notice: Subject to any disclaimer, the term of this patent is extended or adjusted under 35 U.S.C. 154(b) by 0 days.

(21) Appl. No.: 10/282,939

(22) Filed: Oct. 29, 2002

(65) Prior Publication Data

US 2003/0091394 A1 May 15, 2003

(30) Foreign Application Priority Data

Oct. 31, 2001 (JP) ..... 2001-335682

(51) Int. Cl.[7] ..... G01M 9/02
(52) U.S. Cl. ..... 404/1; 73/147
(58) Field of Search ..... 404/1, 74; 73/147

(56) References Cited

U.S. PATENT DOCUMENTS

| | | | | | |
|---|---|---|---|---|---|
| 3,721,466 | A | * | 3/1973 | Abrams | 296/180.4 |
| 4,945,594 | A | * | 8/1990 | Tomb | 73/86 |
| 2003/0070479 | A1 | * | 4/2003 | Lacey | 73/147 |
| 2003/0089167 | A1 | * | 5/2003 | Markstaller et al. | 73/147 |

FOREIGN PATENT DOCUMENTS

| | | | | | |
|---|---|---|---|---|---|
| JP | 08053802 | A | * | 2/1996 | E21F/1/00 |
| JP | 2001317001 | A | * | 11/2001 | E01C/1/00 |
| JP | 2002228542 | A | * | 8/2002 | E21F/1/00 |
| JP | 2002275837 | A | * | 9/2002 | E01C/1/04 |
| JP | 2001200511 | A | * | 7/2003 | E01C/1/00 |

* cited by examiner

*Primary Examiner*—Robert E. Pezzuto
*Assistant Examiner*—Alexandra K. Pechhold
(74) *Attorney, Agent, or Firm*—Dennis T. Griggs

(57) ABSTRACT

An improved tunnel or covered highway structure with means for easy and quick access to the interior. The structure includes a wind tunnel built over a highway and a wind deflector slab provided near the exit end of the tunnel and having an opening for permitting vehicular traffic to pass therethrough. The wind deflector functions to deflect upwardly the air flow generated by the piston action of traffic moving in the tunnel so as to diffuse air pollutants such as carbon monoxide and traffic noise. The wind tunnel includes vent openings and/or side entrances which are normally closed to prevent ventilation of the tunnel therethrough but can selectively be opened to reduce wind pressures generated by piston action of the moving traffic so that the operation of maintenance personnel may not be hampered thereby during repairs.

6 Claims, 8 Drawing Sheets

COVERED HIGHWAY STRUCTURE WITH MEANS FOR EASY AND QUICK ACCESS TO TUNNEL INTERIOR

BACKGROUND OF THE INVENTION

This invention relates to an improved covered highway structure for use in heavily urbanized areas to reduce traffic noise and air pollution and, more particularly, to a tunnel structure including means for permitting easy and quick access to tunnel interior when accidents such as car collisions or fires occur.

A depressed highway is often constructed in heavily urbanized areas for carrying heavy, noisy traffic. It is formed by cutting a channel into the ground and constructing a highway track along the bottom of the channel. However, the construction of such a depressed highway is usually quite expensive because of excavations involved.

To avoid such limitations of the prior art, it has been proposed to provide a wind tunnel structure which encloses a highway at the ground surface, as disclosed in Japanese Laid Open Patent Application No. 2001-200511. The proposed tunnel structure includes a wind tunnel built over a highway and a slanting wind deflector slab provided at the exit end of the tunnel. The tunnel is ventilated by the piston action of the moving traffic, assisted by fans or blowers, to push air from the entrance toward the exit of the tunnel. The exiting air is deflected upwardly by the wind deflector slab for increased diffusion of air pollutants such as carbon monoxide and traffic noise.

However, it has been found that a covered highway sometimes causes a significant problem. The covered highway has no side entrances in the intermediate portion thereof that permit easy and quick access to the interior when accidents such as car collisions or fires occur. Also, the covered highway structure disclosed in the Japanese laid open application does not have vent openings either. It will be understood that the absence of openings such as side entrances and vent openings will inevitably cause difficulties to maintenance personnel in repairing road surfaces and tunnel inner walls because their operation is hampered by rather strong wind generated by the piston action of the moving traffic.

The present invention provides an improved covered highway structure which substantially eliminates or reduces the above described problems. The highway structure includes openings such as side entrances and/or vent openings provided in the tunnel roof. The side entrances are normally closed to prevent ventilation of the tunnel therethrough but can be opened to permit entry of fire engines and ambulances into tunnel interior in the event of accidents such as car collisions or fires. A plurality of such side entrances may be provided at equal intervals along the length of the tunnel, although the present invention is not limited to any specific location and spacing of the side entrances. The vent openings are also normally closed but can be opened to ease the wind pressure problem experienced by maintenance personnel during repair work.

BRIEF DESCRIPTION OF THE DRAWINGS

A better understanding of the invention will be obtained by reference to the description of preferred embodiments below, with reference to the following drawings in which.

DETAILED DESCRIPTION OF THE INVENTION

Figure 1:
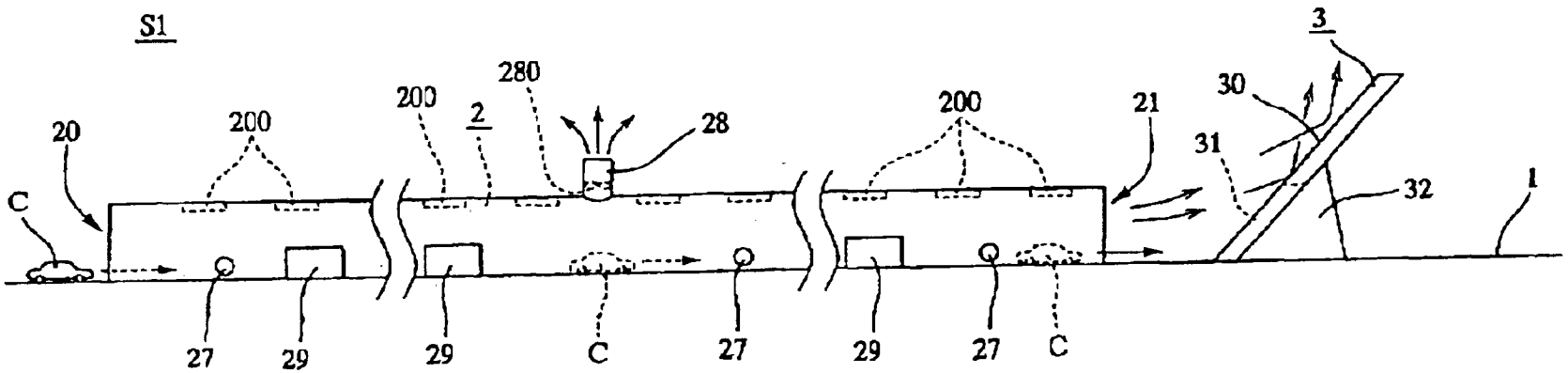
FIG. 1 is a side elevational view, partly cut away, of a covered highway structure according to a first embodiment of the present invention.
Figure 2:
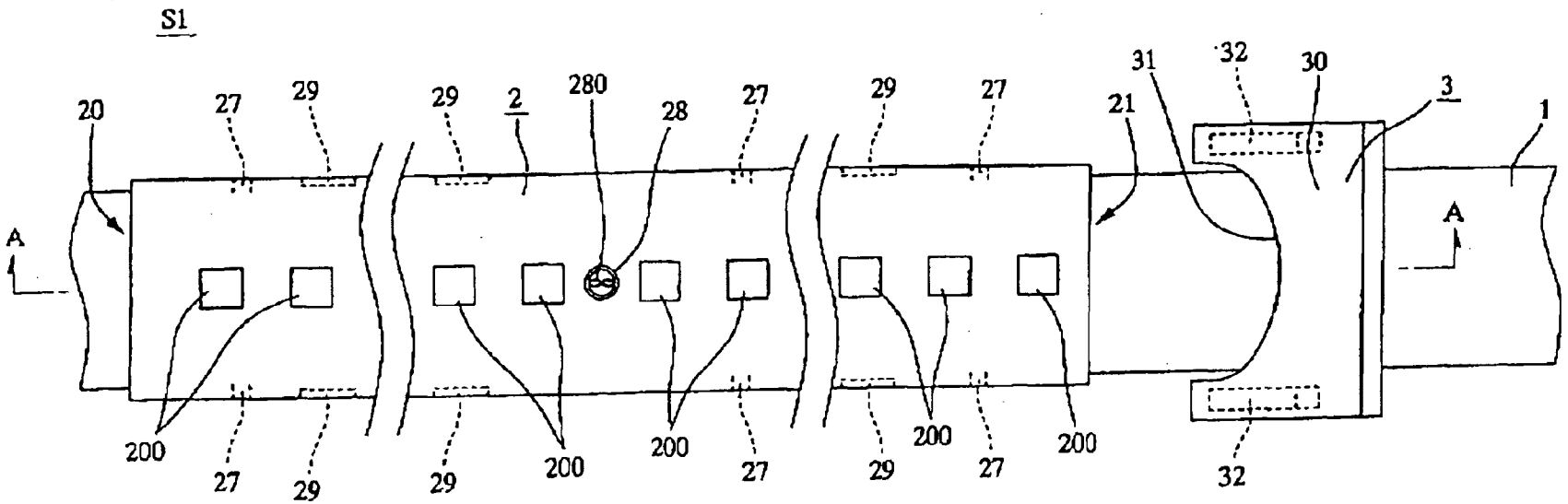
FIG. 2 is a plan view, partly cut away, of the covered highway structure shown in FIG. 1.
Figure 3:
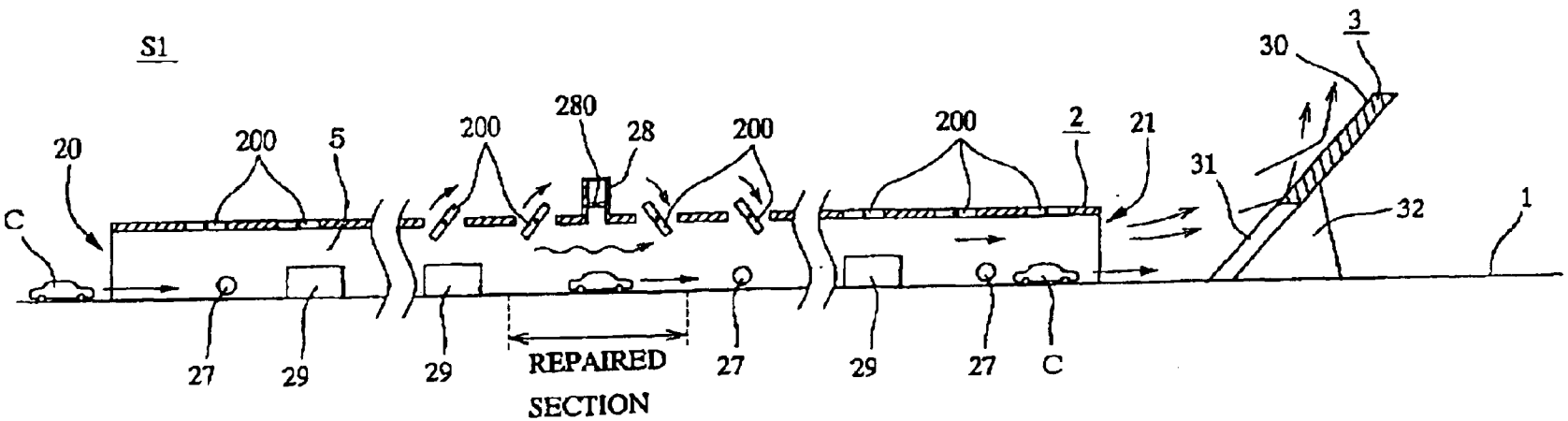
FIG. 3 is s lateral sectional view of the covered highway structure shown in FIG. 1 with roof vent openings in a repaired section kept open.

Referring to the drawings and, initially, to FIGS. 1–3, a tunnel or covered highway structure S1 is shown, constructed in accordance with the present invention by covering a highway 1 along which automobiles C pass. The structure S1 consists of a wind tunnel 2 which covers or encloses a certain section of the highway 1, and a slanting wind deflector 3 provided near an exit 21 of the tunnel 2.

The wind tunnel 2 includes an entrance 20 at the end opposite to the exit 21 for ingress of the vehicular traffic and is generally rectangular, semicircular, inverted U or V in cross section. Preferably, the covered highway structure or tunnel S1 may be several hundreds meters to several kilometers in length so that the piston action of vehicular traffic moving through the tunnel 2 can produce a sufficient wind speed at the exit 21 to enable the wind deflector 3 to deflect the wind upwardly thereby efficiently and effectively diffusing air pollutants such as carbon monoxide and traffic noise in heavily urbanized areas.

The wind tunnel 2 may preferably be constructed of a light transmitting plastic material and have a structural strength sufficient to withstand wind pressures developed from hurricane, typhoon and the like. Such plastic material should be air and water-impervious. However, the wind tunnel 2 may be formed of any other suitable materials such as concrete, metal, wood, cloths and the like with adequate structural support provided by a metal framework.

The wind tunnel 2 may be lined with a sound absorbing material 5 substantially all over the inner wall thereof to reduce traffic noise. Other sound absorbing means may be used including vibration isolating devices, vibration damping devices, active noise control devices and the like.

The wind tunnel 2 also includes heating means (not shown) for heating the wind generated by the piston action of the moving traffic. The heating means may be comprised of electric heaters, oil heaters, solar heaters and the like. The use of the wind heaters, coupled with the latent heat of exhaust gases from automobiles C, will tend to cause the air mass in the tunnel to rise toward the ceiling due to buoyancy.

The slanting wind deflector 3 may be constructed of steel reinforced concrete or plastic material and may be structurally supported by support members 32. As best seen in FIG. 2, the wind deflector 3 includes an opening 31 for permitting vehicular traffic to pass therethrough. Preferably, the wind deflector 3 has a smooth surface 30 for promoting upward deflection of air flow and traffic noise. The wind deflector 3 may also include an adsorbent material on the surface 30 that is capable of adsorbing air pollutants contained in exhaust emissions. The adsorbent material may be periodically cleaned to wash away such pollutants.

The covered highway 1 as shown is for one-way vehicular traffic. It should be noted that a plurality of wind deflectors like the one shown in FIGS. 1–3 may be provided one for each lane of a one-way highway. It should also be noted that the wind deflectors should be provided at both ends of the covered highway if it includes a median barrier permitting two-way vehicular traffic.

One important feature of the present invention is that the wind tunnel 2 includes at least one vent opening 200 and at least one side entrance 29, both of which are normally closed to prevent air and traffic noise communication between the interior and the exterior of the tunnel 2. As described above, the side entrances 29 can be used to allow fire engines and ambulances to enter the tunnel therethrough for easy and quick access to tunnel interior.

As best seen in FIG. 3, each vent opening 200 includes a generally flat closure member which is rotatable about a horizontal axis extending across the opening transversely to the length of the tunnel. The vent openings 200 can be kept open to provide for ventilation of the tunnel therethrough. The wind tunnel 2 also includes at least one air duct 28 extending through the roof thereof and having a fan 280 provided therein, which provides for forced ventilation of the tunnel. The position of the closure members of the vent openings 200 and the operation of the duct fan 280 can be controllably adjusted manually or by means of a remote control device.

When repair work is to be conducted in the tunnel 2, it is advantageous to selectively open some of the vent openings 200 and the side entrances 29, particularly those located adjacent to a repaired section upstream and downstream thereof, so that wind pressures experienced in the repaired section may be reduced to minimize interference to repair activities. Specifically, only the vent openings 200 and the side entrances 29 located adjacent to the repaired section upstream thereof may desirably be opened to allow the wind pressures generated in the upstream section by the piston action of the moving traffic to vent out therethrough, while only the vent openings 200 and the side entrances 29 located adjacent to the repaired section downstream thereof may desirably be opened to allow entry of air into the tunnel 2 therethrough so as to maintain the wind speed in the downstream section of the tunnel.

The wind tunnel 2 may also be provided with air supply or removal means 27 for forcedly supplying or removing air into or from the tunnel 2. The air supply or removal means 27 serves to prevent air from becoming stagnant when vehicular traffic in the tunnel is very light. By selectively controlling a plurality of such air supply or removal means 27 provided along the length of the tunnel 2, it is possible to not only prevent such air stagnancy but also selectively adjust the flow rate of air locally or throughout the tunnel 2.

Figure 4:
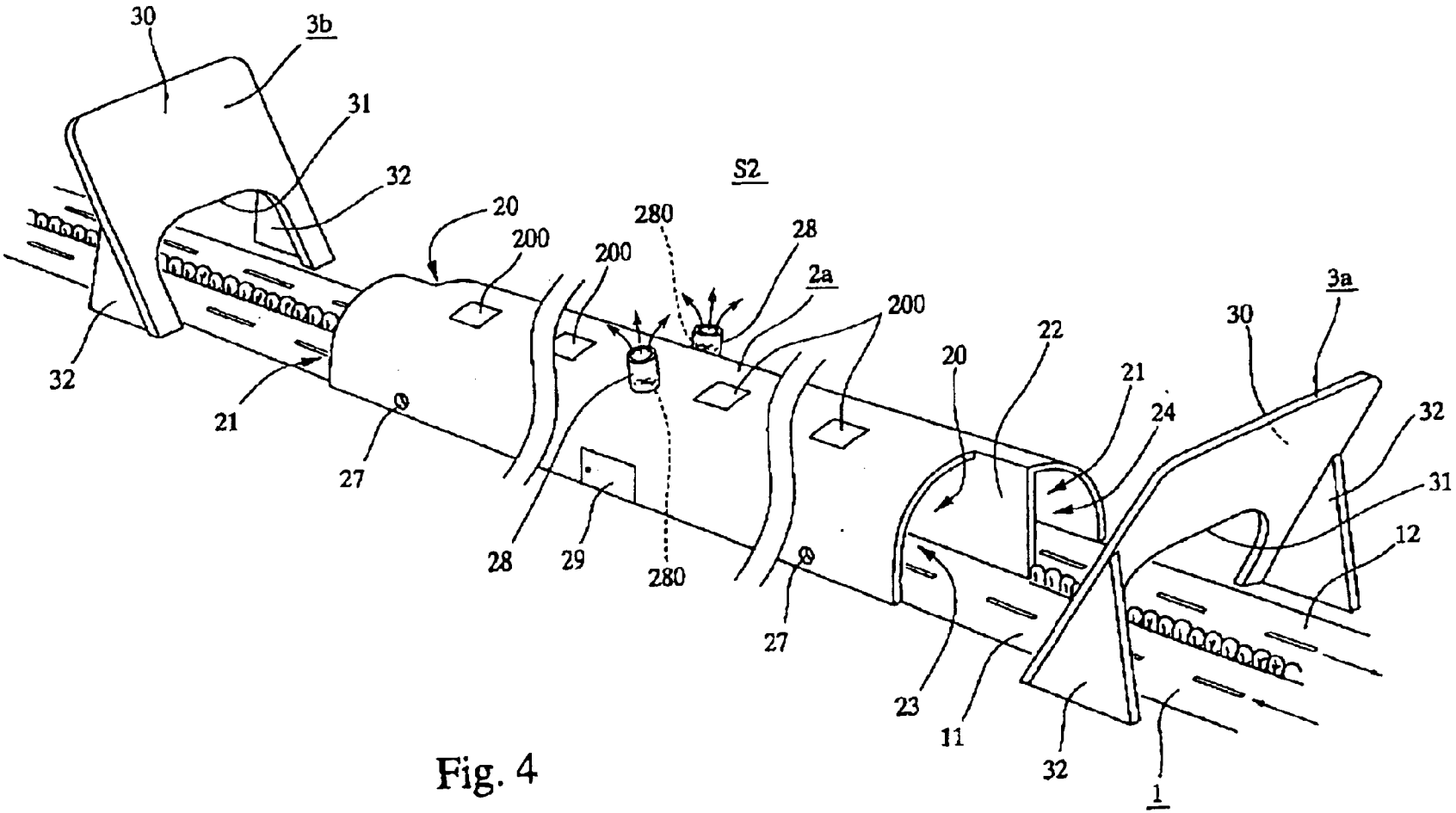
FIG. 4 is a schematic perspective view, partly cut away, of a covered highway structure according to a second embodiment of the invention.

Referring to FIG. 4, there is illustrated a covered highway structure S2 as constructed in accordance with a second embodiment of the present invention. In this figure, like reference numerals indicate the same or similar portions of the highway structure. This covered highway structure S2 differs from the structure of FIGS. 1–3 in that it is built over a highway 1 for two-way traffic, including a median barrier 22 separating the interior of the tunnel 2*a* into two tubular spaces 23, 24. It is to be noted that the exit end 21 of each tubular space 24 is arranged to be closer to the wind deflector 3*a*, 3*b* than the entrance end 20 of its adjacent tubular space 23 so that the air flow being pushed out from the exit end of one tubular space 24 due to the piston action of the moving traffic may be least disturbed by the air flow sucked into the other tubular space 23 through the entrance end 20. It should also be noted that includes the covered highway structure S2 includes two vent openings 28 communicating respectively with two separate tubular spaces 23, 24 on the two-way highway.

Figure 5:
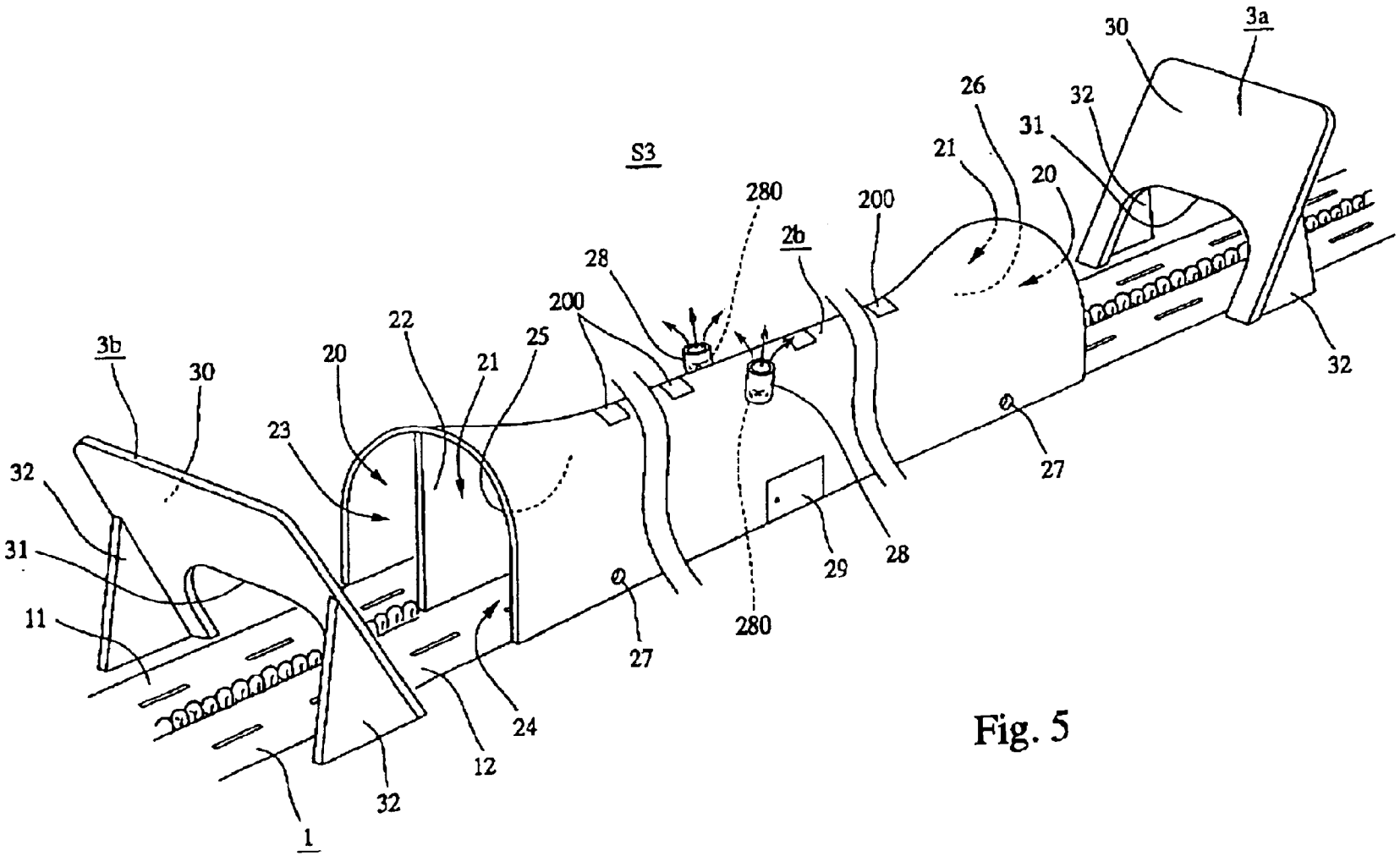
FIG. 5 a schematic perspective view, partly cut away, of a covered highway structure according to a third embodiment of the invention.

Referring to FIG. 5, there is illustrated a covered highway structure S3 as constructed in accordance with a third embodiment of the present invention. In this figure, like reference numerals designate the same or similar portions of the highway structure. This covered highway structure S3 differs from the structure of FIGS. 1–3 in that both ends of the wind tunnel 2*b* are flared upwardly as generally shown at 25, 26. In other words, the height of the tunnel roof generally increases gradually toward both ends of the tunnel 2*b*. As described above, the air mass in the tunnel has buoyancy due to the latent heat of exhaust emissions and the heat added thereto by heating means. When vehicular traffic in the tunnel is light, the air mass present in the tunnel 2*b* tends to be stagnant due to insufficient piston action of moving traffic. However, it should be understood that the flared ends of the covered highway structure S3 will act to minimize air stagnancy with the assistance of the buoyancy of air in the tunnel.

Figure 6:
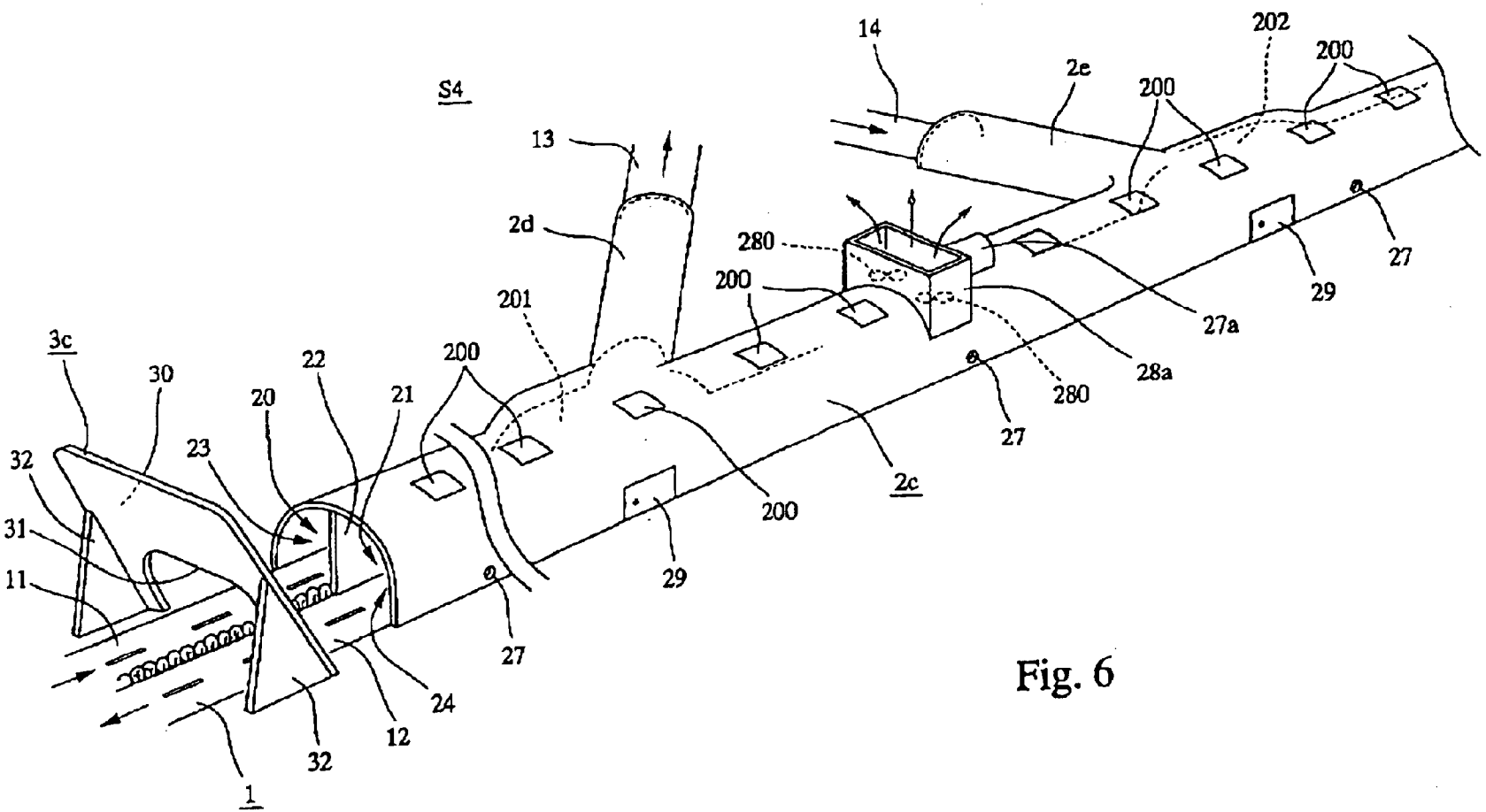
FIG. 6 is a schematic perspective view, partly cut away, of a covered highway structure according to a fourth embodiment of the invention.
Figure 7:
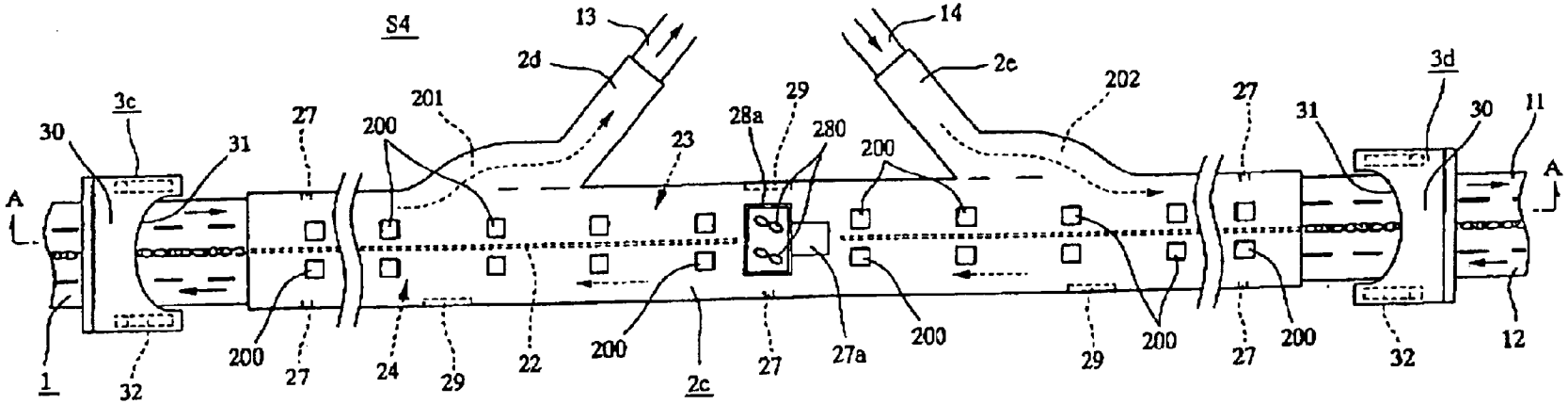
FIG. 7 is a plan view, partly cut away, of the covered highway structure shown in FIG. 6.
Figure 8:
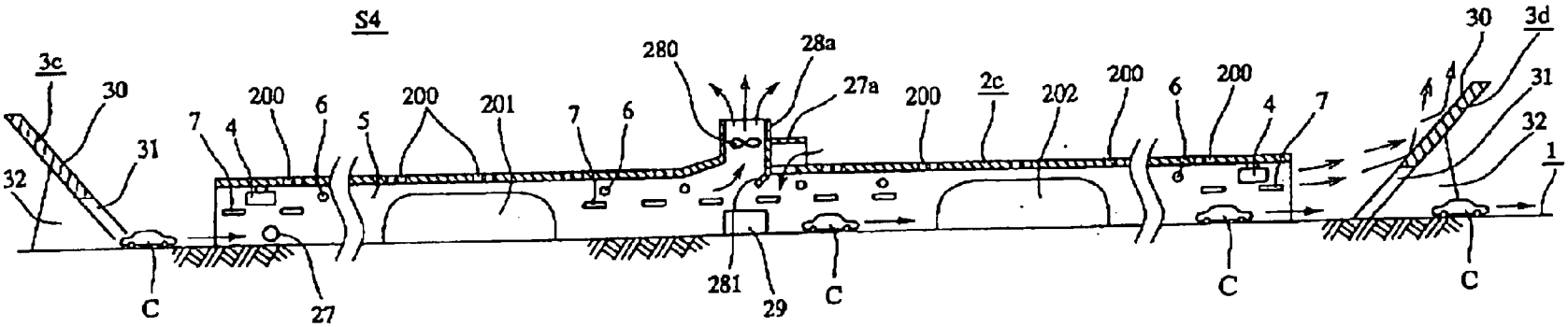
FIG. 8 is a lateral sectional view taken generally along line A—A of FIG. 7.

Referring to FIGS. 6–8, there is illustrated a covered highway structure S4 as constructed in accordance with a fourth embodiment of the present invention. In these figures, like reference numerals designate the same or similar portions of the highway structure. This covered highway S4 differs from the structure of FIG. 4 in that it has connected to one tubular space 23 a tunnel 2*d* for diverting traffic 13 and a tunnel 2*e* for merging traffic 14. Also, as shown in FIG. 8, a plurality of blowers 4 are provided on the ceiling of the tunnel at strategic points so that the wind speed in the direction of moving traffic can be controllably adjusted in an appropriate manner. The tunnel structure S4 also includes air cleaners 6 for cleaning exhaust emissions and air heaters 7 for heating the air moving in the tunnel. A vent duct 28*a* is provided extending through the tunnel roof and has two fans 280 therein that can control ventilation of two separate tubular spaces 23, 24 individually.

As shown in FIG. 8, the vent duct 28*a* has associated therewith a deflector plate 281 depending from the roof into tunnel 2*c* rather obliquely toward the entrance end 20. This deflector plate 281 acts to increase the efficiency with which the vent duct 28*a* removes exhaust gases emitted from automobiles C when moving in a section upstream of the vent duct 28*a* as well as the efficiency of supplying fresh air into a section downstream of the vent duct 28*a* through an auxiliary duct 27*a*.

It is to be understood that the above description is intended to be illustrative, and not restrictive. May other embodiments will be apparent to those of skill in the art upon reading and understanding the above description. The scope of the invention should, therefore, be determined with reference to the appended claims, along with the full scope of equivalents to which such claims entitled.

I claim:

1. A tunnel structure for covering a highway, comprising a wind tunnel having an entrance end and an exit end, and at least one slanting wind deflector provided near the exit end of the wind tunnel, said at least one wind deflector having an opening to allow vehicular traffic to pass therethrough and being operable to deflect upwardly the air flow generated by the piston action of vehicular traffic moving in the wind tunnel so as to diffuse air pollutants and traffic noise, said wind tunnel including a plurality of vent openings which are normally closed to prevent ventilation of the tunnel therethrough and means for selectively opening only those vent openings located adjacent to a repaired section upstream thereof to allow wind pressures generated in the upstream section by the piston action of the moving traffic to vent out therethrough while opening only those vent openings located adjacent to the repaired section downstream thereof to allow entry of air into the tunnel therethrough so that maintenance personnel can perform repair work efficiently and effectively.

2. A tunnel structure for covering a high way, comprising a wind tunnel having an entrance end and an exit end, and at least one slanting wind deflector provided near the exit end of the wind tunnel, said at least one wind deflector having an opening to allow vehicular traffic to pass therethrough and being operable to deflect upwardly the air flow generated by the piston action of vehicular traffic moving in the wind tunnel so as to diffuse air pollutants and traffic noise, said wind tunnel including a plurality of side openings provided in the intermediate portion thereof, which are normally closed to prevent ventilation of the tunnel therethrough and means for selectively opening only those side openings located adjacent to a repaired section upstream thereof to allow wind pressures generated in the upstream section by the piston action of the moving traffic to vent out therethrough while opening only those side openings located adjacent to the repaired section downstream thereof to allow entry of air into the tunnel therethrough so that maintenance personnel can perform repair work efficiently and effectively.

3. A tunnel structure according to claim 1 or 2, wherein said wind tunnel is flared upwardly toward the exit end thereof so as to permit the air mass in the tunnel to move toward the exit end due to buoyancy provided to the air mass by the latent heat of exhaust emissions.

4. A tunnel structure according to claim 1 or 2, further comprising means for heating the air in the tunnel so as to provide buoyancy thereto.

5. A tunnel structure according to claim 1 or 2, further comprising blower means for accelerating or decelerating the air flow moving in the wind tunnel.

6. A tunnel structure according to claim 1 or 2, wherein said wind tunnel comprises a heat insulating wall.

* * * * *